US009840942B2

(12) United States Patent
Zwahr et al.

(10) Patent No.: US 9,840,942 B2
(45) Date of Patent: Dec. 12, 2017

(54) CAMSHAFT ADJUSTER

(71) Applicant: Schaeffler Technologies AG & Co. KG, Herzogenaurach (DE)

(72) Inventors: Sebastian Zwahr, Obermichelbach (DE); Jens Schaefer, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 15 days.

(21) Appl. No.: 14/911,566

(22) PCT Filed: Aug. 7, 2014

(86) PCT No.: PCT/DE2014/200390
§ 371 (c)(1),
(2) Date: Feb. 11, 2016

(87) PCT Pub. No.: WO2015/021984
PCT Pub. Date: Feb. 19, 2015

(65) Prior Publication Data

US 2016/0186619 A1 Jun. 30, 2016

(30) Foreign Application Priority Data

Aug. 14, 2013 (DE) ..... 10 2013 216 184

(51) Int. Cl.

| | |
|---|---|
| ***F01L 1/34*** | (2006.01) |
| ***F01L 1/344*** | (2006.01) |
| ***F01L 1/46*** | (2006.01) |
| *F01L 1/047* | (2006.01) |

(52) U.S. Cl.
CPC ..... *F01L 1/34403* (2013.01); *F01L 1/34* (2013.01); *F01L 1/344* (2013.01); *F01L 1/46* (2013.01); *F01L 2001/0475* (2013.01)

(58) Field of Classification Search
CPC ..... F01L 1/34; F01L 1/46; F01L 1/344; F01L 1/34403; F01L 2001/0475
USPC ..... 123/90.15, 90.17, 90.27, 90.31
See application file for complete search history.

(56) References Cited

U.S. PATENT DOCUMENTS 7,841,311 B2 * 11/2010 Hutcheson ..... F01L 1/047 123/90.15

FOREIGN PATENT DOCUMENTS

| | | | |
|---|---|---|---|
| DE | 102010018205 | A1 | 10/2011 |
| JP | S59115411 | A | 7/1984 |
| WO | 2006045389 | A1 | 5/2006 |

* cited by examiner

*Primary Examiner* — Ching Chang
(74) *Attorney, Agent, or Firm* — Simpson & Simpson, PLLC

(57) ABSTRACT

A camshaft adjusting device for an internal combustion engine, comprising a housing comprising a bearing sleeve arranged to be concentrically disposed on a camshaft, the bearing sleeve arranged to be guided through a cylinder head wall, an annular gap arranged to be inside the cylinder head, the annular gap arranged to be formed between the bearing sleeve and the camshaft, an adjusting mechanism comprising a control shaft arranged within the housing, a traction mechanism comprising a drive gear secured to the bearing sleeve outside the cylinder head, and a ball bearing arranged within the drive gear and securing the control shaft within the adjusting mechanism.

11 Claims, 2 Drawing Sheets

CAMSHAFT ADJUSTER

CROSS-REFERENCE TO RELATED APPLICATIONS

The present application is the U.S. national stage application pursuant to 35 U.S.C. §371 of International Application No. PCT/DE2014/200390, filed Aug. 7, 2014, which application claims priority from German Patent Application No. DE 10 2013 216 184.0, filed Aug. 14, 2013, which applications are incorporated herein by reference in their entireties.

TECHNICAL FIELD

The disclosure relates to a camshaft adjusting device for an internal combustion engine, in particular, a belt driven camshaft.

BACKGROUND

A camshaft adjusting device is known from DE 10 2010 018 205 A1. A drive gear of this camshaft adjusting device is firmly connected to an intermediate member, which extends from the drive gear in the direction of the camshaft. One area on the intermediate member is provided as a radial and axial sliding bearing for mounting the camshaft in a cylinder head.

Another camshaft adjusting device is known, for example, from the patent WO 2006/045389 A1. This camshaft adjusting device has a housing that is sealed from the surrounding area and which is firmly connected to a belt pulley. The belt pulley is driven by means of a toothed belt from the crankshaft of the internal combustion engine so that a fixed phase relationship between the angular position of the belt pulley and the angular position of the crankshaft is provided. The adjusting mechanism of the camshaft adjusting device is disposed radially inside the belt pulley and allows an adjustment of the phase relationship between belt pulley and camshaft of the internal combustion engine. The entire camshaft adjusting device, according to WO 2006/045389 A1, is disposed on the outside of the cylinder head of the internal combustion engine. A lubricant may be found in the housing of the camshaft adjusting device, where the lubrication is designed as a lifetime lubrication. Various static and dynamic seals ensure that the housing of the camshaft adjusting device is permanently sealed.

SUMMARY

The object of the present disclosure is to provide a rugged, compact camshaft adjusting device containing reliable seals and having an energy-saving option. This camshaft adjusting device is provided for an internal combustion engine, such as, for example, a gasoline engine, which comprises at least one camshaft, which is driven by a traction means, in particular, a chain or a toothed belt, by way of a drive gear, for example, a belt pulley.

An adjusting mechanism has, as a functional core component of the camshaft adjusting device, a housing, which is firmly connected to the drive gear, in particular, the belt pulley, or is designed as one piece. A control shaft, which is concentric to the camshaft and is part of the adjusting mechanism, is driven, for example, by an electric motor. This electric motor is located in a well-known manner, just like the drive gear of the traction mechanism, on the outside of a cylinder head wall of the internal combustion engine.

The adjusting mechanism protrudes into the cylinder head, where there is an annular gap, formed between the camshaft and a bearing sleeve, inside the cylinder head. In this case the bearing sleeve represents a wall of the housing of the adjusting mechanism and is guided through the wall of the cylinder head and is connected on the outside of the cylinder head wall to the drive gear of the traction mechanism, in particular, the belt drive. The control shaft is mounted by means of a ball bearing in the adjusting mechanism, which is located between the two end faces of the drive gear.

If the phase relationship between the belt pulley or any other type of drive gear and, thus, the crankshaft, on the one hand, and the camshaft, on the other hand, is adjusted by means of the camshaft adjusting device, then the parts defining the annular gap, i.e. the bearing sleeve and the camshaft, are also rotated relative to each other. A separate dynamic seal, acting at this point between the parts, is not provided in an example embodiment.

On the other hand, seals, which seal those parts that can be rotated relative to each other, are provided in the wall of the cylinder head and on the outside of the wall of the cylinder head. The control shaft, which is centrally located inside the bearing sleeve of the camshaft adjusting device, is sealed from the bearing sleeve, for example, sealed by means of a sealing ring, which is located on the end face of the adjusting mechanism that faces away from the wall of the cylinder head and, thus, also on the end face of the drive gear. In an example embodiment, this sealing ring has an outside diameter, which is smaller than the maximum diameter of the camshaft.

Another sealing ring, which is also small in size, is provided for sealing the bearing sleeve from the wall of the cylinder head. The inside diameter of this sealing ring is, for example, smaller than the outside diameter of the former sealing ring, which seals the control shaft from the bearing sleeve. The maximum outside diameter of the bearing sleeve is, for example, at most 30%, for example, at most 20%, in particular, at most 10%, larger than the maximum outside diameter of the camshaft. In an example embodiment, no part of the adjusting mechanism has a larger diameter than the bearing sleeve.

The arrangement of the seals radially close to the axis of rotation of the drive gear, which is designed, for example, as a belt pulley, and, thus, close to the axis of rotation of the camshaft makes it possible to keep the tolerance chains in the camshaft drive short, so that it is possible to use sealing rings that have very small radial flexibility and at the same time low friction simply because of the small effective diameter and have long-term consistent properties. In addition, the number of points to be sealed is extremely small as compared to conventional solutions.

In a modified embodiment the drive gear, connected to the bearing sleeve, is designed as a gear wheel, so that the drive of the camshaft can occur, for example, by way of a vertical shaft. In this case, too, the drive gear is arranged outside the cylinder head.

In an example embodiment, the installation space, which is available in the radial direction inside the drive gear and which can, in principle, be completely filled by a gearbox, is utilized by the adjusting mechanism of the camshaft adjusting device only to a relatively small extent. The outside diameter of the bearing sleeve is preferably at most 50%, in particular, at most 30%, of the diameter of the drive gear.

However, in the axial direction, relative to the axis of rotation of the camshaft and the drive gear, the components of the camshaft adjusting device are significantly broader than in the solutions according to the prior art. The total length of the camshaft adjusting device, measured in the axial direction, is preferably at least twice as large as the diameter of the bearing sleeve, so that all of the transmission components of the adjusting mechanism are disposed inside the outside diameter of the bearing sleeve.

In an example embodiment, the bearing sleeve itself forms a transmission component of the adjusting mechanism, where at least one inner tooth arrangement is formed directly on the inner circumference of the bearing sleeve. At least one inner tooth arrangement of the adjusting mechanism is arranged in an example way on both the outside of the wall of the cylinder head and on the inside of the wall of the cylinder head. The entire adjusting mechanism is designed preferably as a triple shaft gear mechanism. The expansion of that section of the adjusting mechanism that is located inside the camshaft, where in this case the expansion is measured in the axial direction, is, for example, greater than the maximum outside diameter of the camshaft. The housing of the adjusting mechanism, which is largely formed by the bearing sleeve, encloses a lubricant chamber, which is greased or lubricated, for example, with oil.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
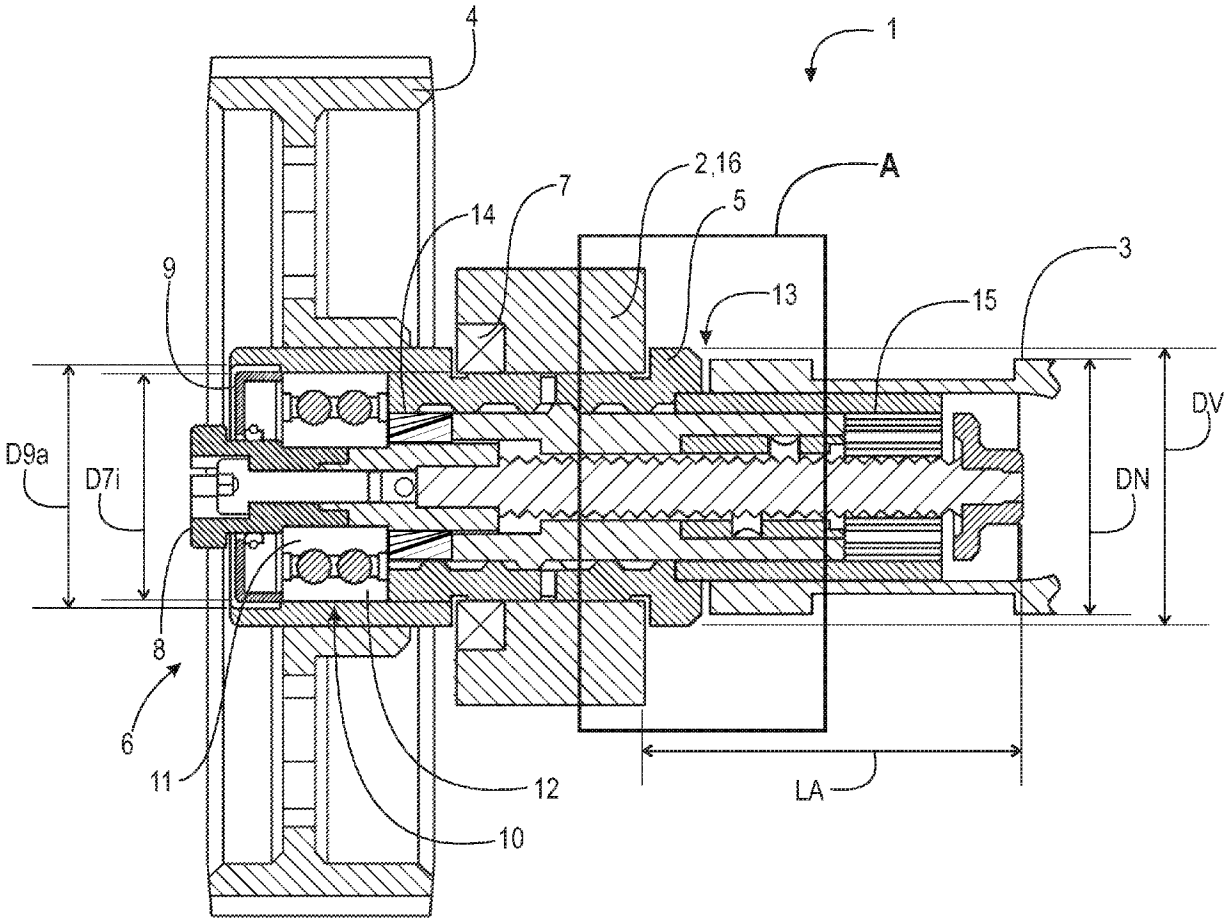
FIG. 1 is a cross-sectional view of a camshaft adjusting device for an internal combustion engine.
Figure 2:
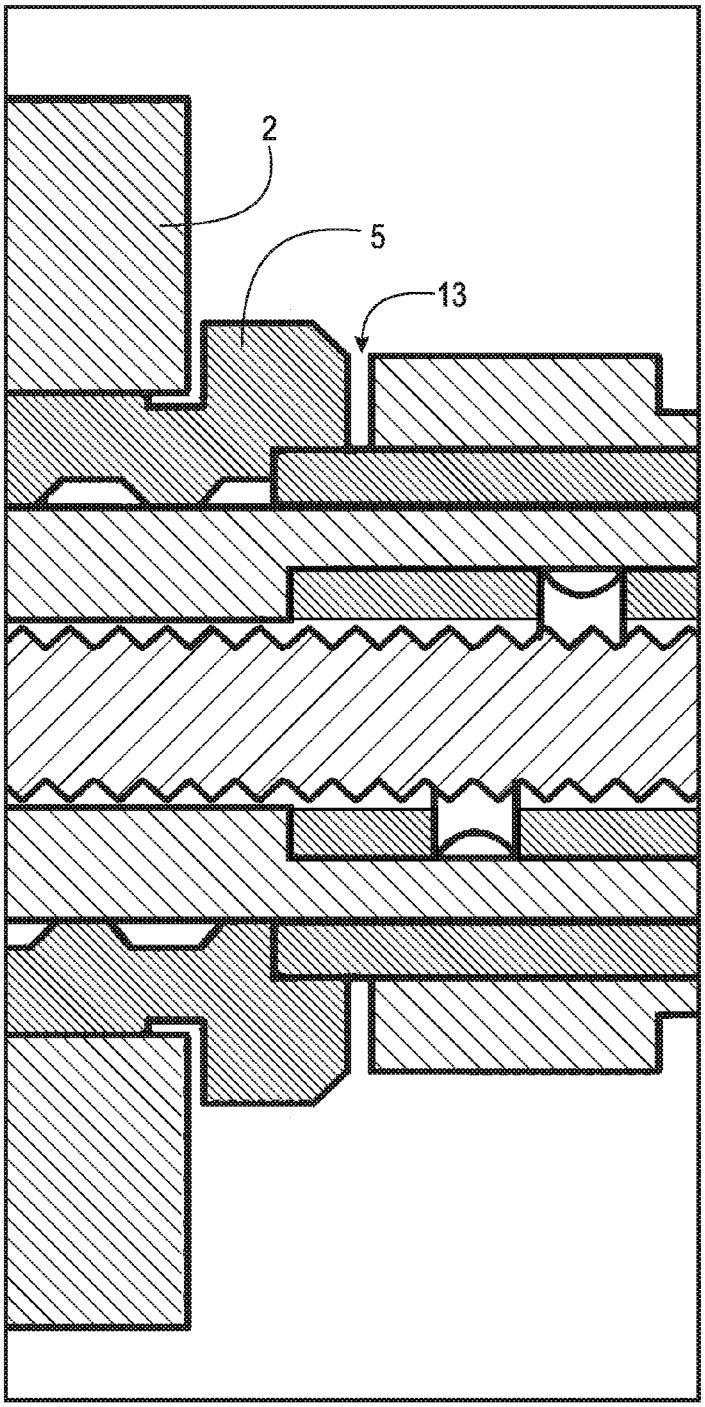
FIG. 2 is an enlarged view of section A in FIG. 1.

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

A camshaft adjusting device, which is identified in its entirety with the reference numeral 1, is used to adjust the timing of the gas exchange valves (not shown) of a combustion engine, which is designed as a gasoline engine or diesel engine and is commonly referred to as the internal combustion engine.

In FIG. 1 cylinder head wall 2 is indicated as a component of the internal combustion engine. The space to the left of cylinder head wall 2 in the arrangement according to FIG. 1 is located outside cylinder head 16; the space to the right of cylinder head wall 2 is located inside cylinder head 16. Inside cylinder head 16 there is also camshaft 3. On the other hand, belt pulley 4, driving camshaft 3, is located on the outside of cylinder head 16. Belt pulley 4 is a dry running drive gear of a traction mechanism.

Belt pulley 4 is firmly connected to bearing sleeve 5, which drives a transmission component of an adjusting mechanism 6 and produces the functionality of camshaft adjusting device 1, i.e. the adjustment of the phase relationship between belt pulley 4 and camshaft 3.

Bearing sleeve 5 extends in the axial direction of camshaft 3 through cylinder head wall 2 and is sealed from cylinder head wall 2 by means of sealing ring 7. In the region of the passage through cylinder head wall 2, bearing sleeve 5 tapers off significantly in relation to the immediately adjoining regions located outside or inside cylinder head 16. The maximum outside diameter of bearing sleeve 5 is denoted by reference characters DV. Camshaft 3 has maximum outside diameter DN that is more than 90% of maximum outside diameter DV of bearing sleeve 5.

Control shaft 8 of adjusting mechanism 6 is located centrally inside bearing sleeve 5 and is sealed from the bearing sleeve by means of sealing ring 9. Ball bearing 10 is used to support control shaft 8 in adjusting mechanism 6. Ball bearing 10 is designed as a double row bearing with inner ring 11 located directly on control shaft 8 and with outer ring 12 making direct contact with an inner wall of bearing sleeve 5. Ball bearing 10 is located axially between the two end faces of belt pulley 4. On the end face of belt pulley 4 that faces away from cylinder head wall 2, control shaft 8 protrudes, as a single component of adjusting mechanism 6, in the axial direction somewhat beyond belt pulley 4.

When the internal combustion engine is running at a constant phase relationship between the crankshaft and camshaft 3, a torque-proof connection is produced between belt pulley 4 and camshaft 3, corresponding to a camshaft drive without a camshaft adjusting device. In this operating state control shaft 8 rotates at the rotational speed of camshaft 3, that is, at half the crankshaft speed. In this case control shaft 8 is driven by an electric motor, as known, in principle, for example, from WO 2006/074734 A1. Adjusting mechanism 6 is a stepped up triple shaft gear mechanism. If control shaft 8 is rotated relative to belt pulley 4 by means of the electric motor drive (not shown) at a certain angle, then camshaft 3 rotates relative to belt pulley 4 at a much smaller angle. The end face of camshaft 3 that faces cylinder head wall 2 defines annular gap 13, which is also defined by an end face of bearing sleeve 5 inside cylinder head 16. Thus, annular gap 13 is formed between mutually adjustable parts, i.e. on the one hand, bearing sleeve 5, which is firmly connected to belt pulley 4, and on the other hand, camshaft 3. A separate sealing element is not present at annular gap 13. Oil, issuing from annular gap 13, flows into cylinder head 16.

With respect to seal rings 9, 7 inside or outside bearing sleeve 5, the following terms and relationships hold.

Outside diameter D9*a* of sealing ring 9 is larger than inside diameter D7*i* of sealing ring 7 in cylinder head wall 2. Furthermore, outside diameter D9*a* of sealing ring 9 between bearing sleeve 5 and control shaft 8 is smaller than maximum diameter DN of camshaft 3. The small dimensions of sealing rings 7, 9 in the radial direction make it possible to meet the objective of achieving advantages both in terms of the tolerances to be considered when camshaft adjusting device 1 is running and also in terms of the braking torque generated by sealing rings 7, 9.

The extremely space saving design of camshaft adjusting device 1 in the radial direction is also facilitated by the fact that bearing sleeve 5 is not only a housing part, but also a transmission component of adjusting mechanism 6. Inner tooth arrangement 14 of bearing sleeve 5 is located in that part of bearing sleeve 5 that is disposed outside cylinder head wall 2. On the other hand, an additional inner tooth arrangement 15 of adjusting mechanism 6 is located in that part of camshaft adjusting device 1 that is disposed inside cylinder head 16. That part of camshaft adjusting device 1 that is located inside cylinder head 16 has axial length LA that is greater than diameter DN of camshaft 3. Thus, camshaft adjusting device 1 completely fills the installation space in the axial direction, with the installation space being located partly in belt pulley 4, partly in cylinder head wall 2, and partly inside camshaft 3. In addition, the effect of concentrating the mechanical component of camshaft adjusting device 1 close to the axis of rotation of camshaft 3 is that camshaft adjusting device 1 exhibits only a low moment of inertia, which is especially good with regard to the possible rates of change and the demands on the electric motor used to drive control shaft 8.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMBERS

1 camshaft adjusting device
2 cylinder head wall
3 camshaft
4 belt pulley, drive gear
5 bearing sleeve
6 adjusting mechanism
7 sealing ring
8 control shaft
9 sealing ring
10 ball bearing
11 inner ring
12 outer ring
13 annular gap
14 inner tooth arrangement
15 inner tooth arrangement
D7*i* inside diameter of the sealing ring 7
D9*a* outside diameter of the sealing ring 9
DN maximum outside diameter of the camshaft
DV maximum outside diameter of the bearing sleeve
LA axial length of that part of the camshaft adjusting device that is located inside the cylinder head

What is claimed is:

1. A camshaft adjusting device for an internal combustion engine, comprising:

a housing comprising a bearing sleeve arranged to be concentrically disposed on a camshaft, said bearing sleeve arranged to be guided through a cylinder head wall of a cylinder head;

an annular gap arranged to be inside said cylinder head, said annular gap arranged to be formed between said bearing sleeve and said camshaft;

an adjusting mechanism comprising a control shaft arranged within said housing;

a traction mechanism comprising a drive gear secured to said bearing sleeve outside said cylinder head; and, a ball bearing arranged within said drive gear and securing said control shaft within said adjusting mechanism.

2. The camshaft adjusting device recited in claim 1, further comprising:

a first sealing ring sealing said bearing sleeve from said control shaft.

3. The camshaft adjusting device recited in claim 2, wherein an outside diameter of said first sealing ring is smaller than a maximum diameter of said camshaft.

4. The camshaft adjusting device recited in claim 2, further comprising:

a second sealing ring, wherein:

said second sealing ring seals said bearing sleeve from said cylinder head wall; and, an inside diameter of said second sealing ring is smaller than an outside diameter of said first sealing ring.

5. The camshaft adjusting device recited in claim 2, wherein a maximum outside diameter of said bearing sleeve is at most 30% larger than a maximum outside diameter of said camshaft.

6. The camshaft adjusting device recited in claim 1, further comprising:

a first inner tooth arrangement formed directly on an inner circumference of said bearing sleeve, wherein said bearing sleeve forms a transmission component of said adjusting mechanism.

7. The camshaft adjusting device recited in claim 6, wherein said adjusting mechanism comprises a second inner tooth arrangement arranged to be disposed on an inside of said cylinder head wall.

8. The camshaft adjusting device recited in claim 1, wherein:

a section of said adjusting mechanism is arranged to be located inside said camshaft at a length, measured in the axial direction of said camshaft; and, the length is greater than a maximum outside diameter of the camshaft.

9. The camshaft adjusting device recited in claim 1, wherein said adjusting mechanism is designed as a triple shaft gear mechanism.

10. The camshaft adjusting device recited in claim 1, wherein said housing of said adjusting mechanism encloses a lubricant chamber.

11. The camshaft adjusting device recited in claim 1, wherein said drive gear is designed as a belt pulley.

* * * * *